United States Patent [19]

Kirk

[11] Patent Number: 4,512,291

[45] Date of Patent: Apr. 23, 1985

[54] INTERNAL COMBUSTION ENGINE

[76] Inventor: J. David Kirk, 2252 Ottawa Rd., Waukegan, Ill. 60087

[21] Appl. No.: 498,398

[22] Filed: May 26, 1983

[51] Int. Cl.[3] ..... F02B 75/24

[52] U.S. Cl. ..... 123/56 BC; 123/196 M; 123/197 AC

[58] Field of Search ..... 123/55 R, 55 A, 56 R, 123/56 B, 56 BC, 56 C, 197 AB, 197 AC, 196 M

[56] References Cited

U.S. PATENT DOCUMENTS

| | | | |
|---|---|---|---|
| 981,995 | 1/1911 | Godlove et al. | 123/56 BC |
| 1,181,892 | 5/1916 | Hunter | 123/56 BC |
| 2,122,676 | 7/1938 | Bourke | 74/50 |
| 2,147,666 | 2/1939 | Park | 123/56 BC |
| 3,517,652 | 6/1970 | Albertson | 123/56 BC |
| 3,946,706 | 3/1976 | Pailler | 123/56 BC |
| 4,013,048 | 3/1977 | Reitz | 123/56 BC |
| 4,331,108 | 5/1982 | Collins | 123/196 M |

FOREIGN PATENT DOCUMENTS

| | | | |
|---|---|---|---|
| 595404 | 10/1925 | France | 123/56 BC |

*Primary Examiner*—Craig R. Feinberg
*Attorney, Agent, or Firm*—Bayard H. Michael

[57] ABSTRACT

The radial internal combustion engine has two pairs of opposed cylinders arranged on axes at 90 degrees to one another. Each pair of cylinders has opposed pistons, interconnected by a piston rod and scotch-yoke assembly. A piston rod is rigidly connected to each piston and extends inwardly to a heel having a load face transverse the axis of the crankshaft. A pair of rollers are mounted on the throw of the crankshaft with each roller being in alignment with and engaged by the load faces of a pair of the piston rods. Apertured retention plates on each side of each roller are fixed to the heels. The rollers engage the load faces. The crankshaft extends through the apertures in the retention plates and the plates are fixed to the heels by dowel pins positively locating and spacing the heels and the retention plates.

7 Claims, 4 Drawing Figures

INTERNAL COMBUSTION ENGINE

FIELD OF THE INVENTION

This invention relates generally to internal combustion engines operating on the two-stroke cycle.

BACKGROUND OF THE INVENTION

The recent growth of the low powered aircraft market has highlighted the shortage of true aircraft engines in the 20–30 horsepower range. The market has made-do with converted automobile, industrial and chain saw engines with weight, reliability and vibration problems.

The following United States patents deal with various aspects of this invention: Bourke, U.S. Pat. No. 2,172,670; Bourke, No. 2,122,676; Bourke, No. 2,122,677; Tetreault, No. 2,466,132; Guaraldi, No. 2,421,198; Hedges, No. 2,460,257; Bentley, No. 3,608,396; Braun, No. 3,610,214; Bruan, No. 3,610,216; Braun, No. 3,610,217; Pailler, No. 3,946,706 and Reitz, No. 4,013,048.

SUMMARY OF THE INVENTION

The principal object of this invention is the provision of a radial internal combustion engine having two pairs of opposed cylinders arranged on axes at 90° to one another and having a single throw crankshaft, each pair of cylinders having opposed pistons interconnected by a piston rod and scotch-yoke assembly comprising a piston rod rigidly connected to each piston and extending inwardly to a heel having a load face transverse the axis of the crankshaft. A pair of rollers are mounted on the throw of the crankshaft with each roller in alignment with and engaged by the load faces of the heels of a pair of the piston rods. Apertured retention plates on each side of each roller are fixed to the heels with the roller in engagement with the load faces. The crankshaft extends through the apertures in the retention plates. The plates are fixed to the heels by dowel pins positively locating and spacing the heels and the retention plates.

Another objective is to provide a wall between the crankcase and each piston in an engine of the type described with the wall having a seal cooperating with the piston rod to seal the crankcase from the area under each piston.

A further object is to provide such an engine in which the pistons supply the sole support and guiding function for the rod/yoke assemblies. The invention provides lightweight crankshaft rollers each including a bearing assembly fixed on the crankpin, a lightweight alloy annulus in engagement with said faces of the heels. The invention also provides such an engine with a volume chamber between the piston and the crankcase wall functioning as a scavenge pump for the associated cylinder. When the piston is at the top of the cylinder, the inlet is uncovered and the air/fuel mixture enters the variable volume chamber. The inlet is covered by the piston skirt as the piston moves down and the charge moves through the transfer passage leading from the variable volume chamber to the space above the piston when the piston reaches the bottom of travel.

DETAILED DESCRIPTION OF THE DRAWINGS

Figure 1:
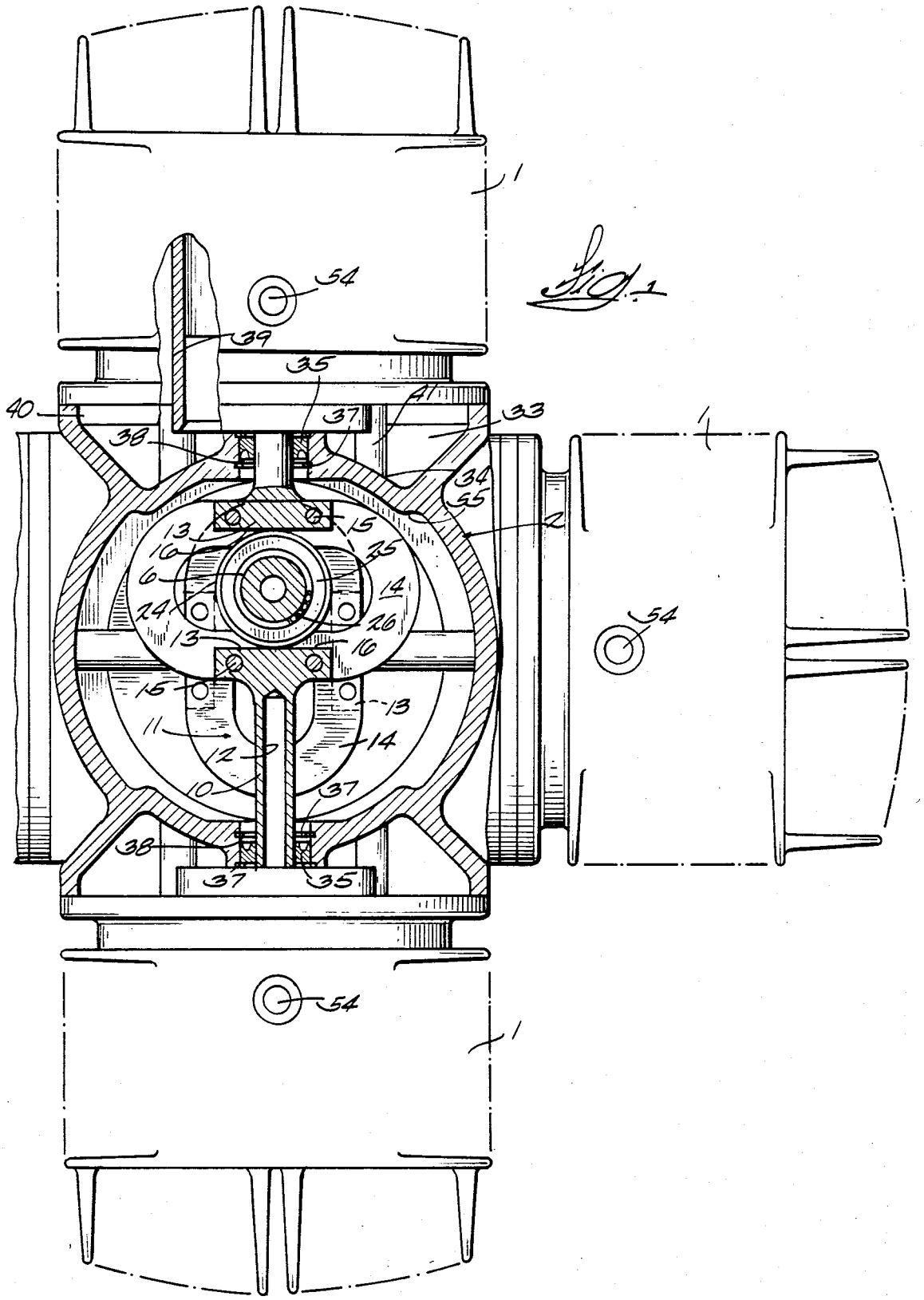
FIG. 1 is an elevation of the engine with some parts broken away to show the scotch yoke construction.
Figure 2:
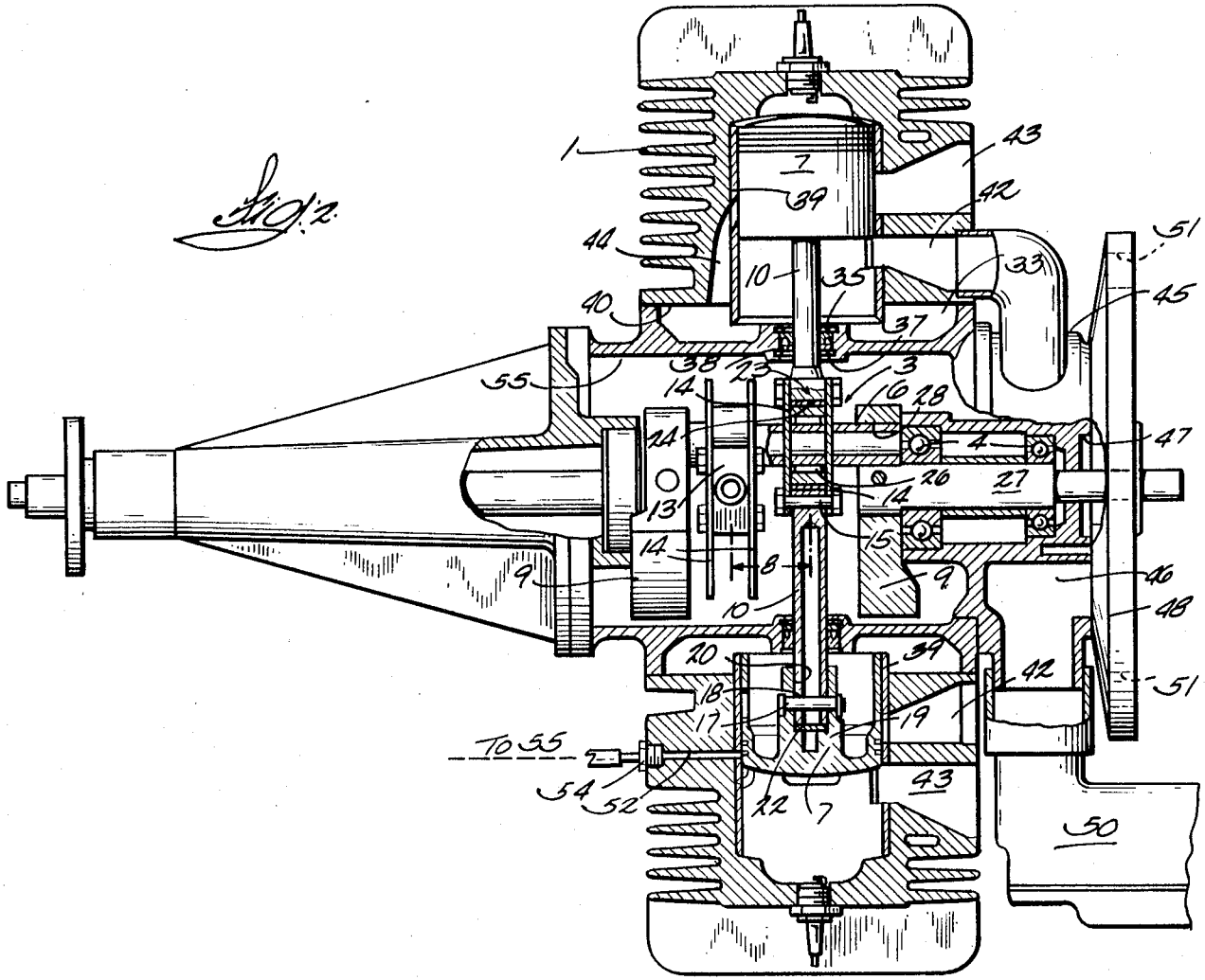
FIG. 2 is a vertical section of FIG. 1.
Figure 3:
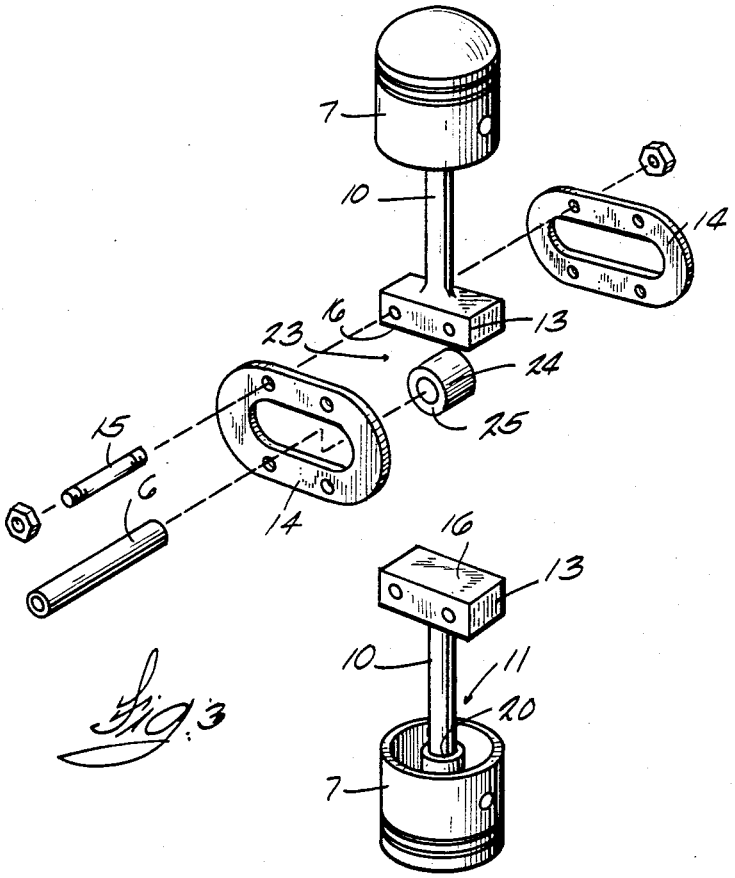
FIG. 3 is an exploded perspective of a rod-yoke assembly.
Figure 4:
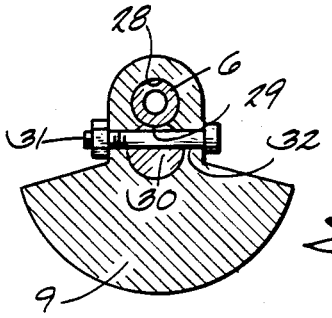
FIG. 4 is a detailed section of a crankthrow and fastener.

This invention comprises an internal combustion engine with cylinders arranged in a radial configuration. The engine may be constructed of several rows of the basic 4-cylinder unit shown. This allows for different sized engines to be easily assembled. The basic unit comprises four radially located cylinders 1 at approximately 90 degree angular spacing, suitably mounted to a crankcase assembly 2, a single throw, counterbalanced crankshaft 3, is housed in the crankcase, with the crankshaft being supported by and revolving in a plurality of main bearings 4.

Two scotch-yoke type reciprocating devices 5 are attached to and drive the single crankpin 6 of the crankshaft. Each reciprocating assembly comprises the mechanical connection for two opposing pistons 7, which by the nature of the mechanism, move unidirectionally. With each reciprocating assembly oriented at approximately 90 degrees to the other, the reciprocative movement of each assembly is approximately 90 degrees out of phase with the other. This allows for evenly spaced cylinder firing intervals of approximately 90 degrees in the basic configuration. As each reciprocating assembly shares the same crankpin 6, a suitable offset 8 is provided for clearance of each of the assemblies.

Suitable counterweights 9, located diametrically opposite the crankpin are sized such that their mass counteracts 100 percent of the reciprocative forces generated by the reciprocating components. In order to keep reciprocating forces to a minimum and reduce overall diameter, an "oversquare" bore/stroke ratio (bore larger than stroke) of 1.3:1 to 1.7:1 inclusive is utilized in this design.

Each rod-yoke assembly 5 consists of two identical piston rods 10 of circular cross section in the rod shank 11, which may be drilled throughout 12 for lightness. At one end of each rod there is attached, either integrally or by fabrication, a "heel" 13 of rectangular cross-section. Two identical yoke plates 14 are affixed by threaded fasteners 15, one plate to each side of the rod heels, thus restraining the heels at a fixed and rigid spacing. Each opposing heel face 16 comprises the working faces of the scotch-yoke assembly. Two dowel-type threaded fasteners 15 are used per rod heel, thus providing the twofold function of assembly retention plus alignment.

Pistons 7 are retained to piston rods 10 by a pin 17, oriented perpendicular to the piston rod axis, and passing through a suitably positioned hole 18 in the piston rod. The interior portion of the piston 7 contains a projection or "boss" 19, integral with the piston. A suitable bore 20 is machined into the boss concentric with the outside diameter of the piston. The bore receives the piston rod shank 11, with the pin 17 passing through suitably positioned holes in the piston boss 21. A thin spacer or "button" 22 is used between the piston rod end and the piston bore for the multiple purpose of transmitting all forces of combustion directly from the piston into the rod, and to allow simplification of machining pin bores due to relaxed tolerances, and ease of alignment when refitting parts during servicing.

The traditional crankpin slider block, commonly used with the scotch-yoke crank mechanism, is replaced by a roller assembly 23. The roller comprises an outer shell 24 or working surface of either hardened steel or aluminum-bronze alloy, forming the outside diameter of said assembly. The shell is interference-fitted over an intermediate ring 25 of high-strength aluminum or other suitable light alloy, for the purpose of reducing mass of said assembly. Into bore of the intermediate ring is interference-fitted a rolling element bearing 26, such as a needle-roller bearing, for the purpose of supporting the roller assembly onto the crankpin and providing a low-friction bearing. However, a plain or bushing-type bearing may also be used in this location. In addition, when weight is not a critical factor, the aluminum intermediate ring may be dispensed with and the entire roller made of hardened steel or aluminum-bronze alloy. Naturally, each of said scotch-yoke reciprocating assemblies uses one roller. The diameter of the roller is slightly less than the spacing of the faces 16 of the heels to enable the roller to move easily transversely of the rod assembly.

The crankshaft 3 is a built-up, or fabricated type of assembly. The assembly consists of two main journals 27, pressed into and welded or furnace brazed to crankthrow-counterweights 9 bores at 28 to receive a pressed-fitted crankpin 6. Due to the short stroke in relation to main journal and crankpin diameters, the crankpin bore overlaps the main journal at 29. This feature provides a desirable interlocking effect of the main journal 30 into the crankthrow, ensuring no slippage of the journal will occur. In order to maintain a firm press fit of the crankpin 6 into the bore 28, a threaded fastener 31 passes through a suitably located hole 32 in the crankthrow, with the hole and fastener located perpendicular to and slightly below the crankpin bore in the crankthrow.

A variable volume chamber, functioning as the scavenge pump 33, is formed in the area of the cylinder, under the piston and to the outermost wall of the crankcase-cylinder mounting area. A suitable depression in the face of the crankcase 34 in this area increases the total volume of the chamber so that a scavange pump compression ratio of 1.2:1 to 1.6:1 inclusive may be obtained. Experience shows that range to be most effective. Higher ratios should be avoided. This volume may be obtained wholly or in part by the crankcase variable volume chamber, a combination crankcase and cylinder volume chamber, or cylinder volume chamber only.

A lip-type sealing device 35 located in the face of the crankcase 2 surrounds the piston rod shank 11 for the purpose of sealing the cylinder scavenge pump chambers 33 from the crankcase interior 55. The seal is retained in its bore by a suitably-placed retaining rings 37 with optional back-up spacers 38 being used on one or both sides of the sealing element. Other forms of sealing may be employed.

The cylinders 1 are located on the crankcase 2 by the following means. The cylinder liner 39, or other suitable cylindrical projection, protrudes a small distance from the cylinder mounting face 40, with the liner engaging suitable machined recesses in the crankcase. In this case, the recesses also form the bosses 41 for threaded fasteners for the purpose of holding the cylinder to the crankcase. The crankcase recesses are machined concentric with piston rod line-of-action for the purpose of exact piloting and radial alignment of the cylinder assembly.

A piston-controlled inlet port 42 is utilize for induction. The inlet port is located directly under the exhaust port 43 for the purpose of piston cooling and allowing the employment of adequate transfer passages 44 on the opposite side of the cylinder. However, the piston port induction is only one form of system that can be utilized on this invention, with reed valve or rotary valve systems also being applicable.

An annular ring-shaped chamber is cast into the rear bearing housing 45, for the purpose of providing an inlet manifold 46 for distribution of a fuel-air mixture to each cylinder from the carburetor 50. The rear bearing housing also contains a cavity 47, machined eccentrically from the crankshaft centerline, with the cavity containing an internal gear oil pump of the gerotor type, for the purpose of supplying lubricating oil to the engine. The rear cover plate 48 assembly forms the following: a cover enclosing the inlet manifold, a cover enclosing and providing oil ports 49 and passageways for the oil pump, and an engine mount 51 for attaching the engine frame to a device.

Cylinder lubrication is accomplished by specifically-located oil drillways 52 in each cylinder assembly 1. Each drillway is positioned to communicate directly with the cylinder bore surface, allowing the piston 7 to cover and uncover the drillway during the piston's reciprocating motion. A drillway during the piston's reciprocating motion. A check valve 54 is also provided, allowing for fluid flow through the drillway into the cylinder only, and blocking any flow away from the cylinder. The oil passage is routed to, and terminates by opening into the crankcase interior 55.

Operation of cylinder lubrication system is as follows: on the upstroke of the piston, a vacuum is formed in the underside portion of the cylinder for the purpose of inducting fuel-air mixture. Prior to inlet port opening, movement of the piston uncovers the oil drillway, at which time oil vapor is drawn from the crankcase through the oil drillway, through open check valve, and into the cylinder, depositing the oil on the cylinder wall and into the air-fuel mixture. On the downstroke of the piston, positive pressure is formed on the underside of the cylinder for the purpose of scavenging. During this phase and prior to piston covering the oil passage, the check valve closes, preventing the residual oil vapor residing in the passage from flowing back into the crankcase interior.

I claim:

1. A radial two-stroke internal combustion engine having two pairs of opposed cylinders arranged on axes at 90 degrees to one another and having a single throw crankshaft, each pair of cylinders having opposed pistons, a piston rod rigidly connected to each piston and extending inwardly to a cross piece having a load face transverse the axis of the engine, a pair of rollers mounted on the single throw of said crankshaft each in alignment with and engaged by the load faces of a pair of the piston rods, apertured retention plates with each plate on opposite sides of each roller along the axis of the crankshaft fixed to the cross pieces with the roller in engagement with the load faces and the crankshaft extending through the apertures, the plates being fixed to the inner ends of each of the rods by dowel bolts positively locating and spacing the load faces and the retention plates, the two pairs of pistons being axially offset, and counterweights on said crankshaft, wherein each of the rollers includes a bearing assembly having an interior and an exterior with roller elements therebetween, said interior being fixed on the crankpin, a lightweight alloy annulus having an interior and an exterior and said interior of said annulus being press fit on said exterior of the bearing assembly to reduce the mass of the roller assembly, and a wear shell press fit on said exterior of said annulus and engageable with said faces of the heels.

2. A radial internal combustion engine having two pairs of opposed cylinders arranged on axes at 90 degrees to one another and having a single throw crankshaft, each pair of cylinders having opposed pistons, each pair of opposed pistons being interconnected by a piston rod and scotch-yoke assembly comprising, a piston rod rigidly connected to each piston and extending inwardly to a heel having a load face transverse the axis of the crankshaft, a pair of rollers mounted on the throw of the crankshaft with each roller being in alignment with and engaged by the load faces of a pair of the piston rods, apertured retention plates with each plate on opposite sides of each roller along the axis of the crankshaft and fixed to said heels with the roller in engagement with the loading faces, the crankshaft extending through the apertures in the retention plates, the plates being fixed to the heels by dowel bolts positively locating and spacing the heels and the retention plates, and counterweights on the crankshaft wherein each of the rollers includes a bearing assembly having an interior and an exterior with roller elements therebetween, said interior being fixed on the crankpin, a lightweight alloy annulus having an interior and an exterior and said annulus being press fit on said exterior of the bearing assembly to reduce the mass of the roller assembly, and a wear shell press fit on said exterior of said annulus and engageable with said faces of the heels.

3. An engine according to claim 2 in which said pistons supply the sole support and guiding function for the rod-yoke assemblies.

4. An engine according to claim 2 including a variable volume chamber between the piston and said crankcase wall, said variable volume chamber functioning as a scavenge pump for the associated cylinder, an intake to said variable volume chamber through the cylinder wall operative when the piston is at the top of the cylinder to permit air/fuel mixture to enter the variable volume chamber, said inlet being covered by the piston skirt as the piston moves down in the cylinder, an exhaust port leading from each cylinder located above the inlet, and a transfer passage leading from the variable volume chamber to the space above the piston and opened by the piston reaching the bottom of travel.

5. An engine according to claim 2 including an forodial intake manifold spaced axially of said crankcase and having an inlet, carburetor means mounted on the inlet for mixing fuel and air for delivery to the manifold, means connecting said manifold to each inlet to each of the cylinders, an oil pump, and means for delivering oil to each cylinder.

6. An engine according to claim 2 in which the scotch-yoke and crankshaft are in a crankcase and there is a wall between the crankcase and each piston, each of said walls being apertured to permit the piston rod to pass therethrough, and seal means supported by said wall and cooperating with each piston rod to seal the crankcase from the area under each piston.

7. An engine according to claim 6 in which each cylinder assembly is fixed on the crankcase, each cylinder being provided with a sleeve which extends from the bottom of the cylinder assembly and is received in a recess in the crankcase to thereby locate the sleeve and cylinder relative to the crankcase, and means securing the cylinder to the crankcase with the sleeve captured therebetween.

* * * * *